US007054568B2

(12) United States Patent
Mizes et al.

(10) Patent No.: US 7,054,568 B2
(45) Date of Patent: May 30, 2006

(54) METHOD AND APPARATUS FOR CONTROLLING NON-UNIFORM BANDING AND RESIDUAL TONER DENSITY USING FEEDBACK CONTROL

(75) Inventors: Howard A. Mizes, Pittsford, NY (US); Shu Chang, Pittsford, NY (US); Anne-Claire K. Markle, West Henrietta, NY (US); Nancy B. Goodman, Webster, NY (US); Gerald M. Fletcher, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 120 days.

(21) Appl. No.: 10/793,902

(22) Filed: Mar. 8, 2004

(65) Prior Publication Data

US 2005/0196187 A1 Sep. 8, 2005

(51) Int. Cl.
*G03G 15/00* (2006.01)
*G03G 15/08* (2006.01)

(52) U.S. Cl. ..... 399/49; 399/15; 399/60

(58) Field of Classification Search ..... 399/15, 399/60, 53

See application file for complete search history.

(56) References Cited

U.S. PATENT DOCUMENTS

| | | | | | |
|---|---|---|---|---|---|
| 5,307,119 | A | | 4/1994 | Folkins et al. | 399/46 |
| 5,333,037 | A | * | 7/1994 | Inoue et al. | 399/49 |
| 5,581,221 | A | * | 12/1996 | Kawai et al. | 399/49 |
| 5,619,307 | A | | 4/1997 | Machino et al. | 399/11 |
| 5,722,009 | A | | 2/1998 | Haneda et al. | 399/60 |
| 5,893,008 | A | | 4/1999 | Budnik et al. | 399/26 |
| 5,895,141 | A | * | 4/1999 | Budnik et al. | 399/60 X |
| 5,923,920 | A | * | 7/1999 | Ishida et al. | 399/49 X |
| 5,983,044 | A | * | 11/1999 | Kodama et al. | 399/49 |
| 6,061,533 | A | * | 5/2000 | Kajiwara | 399/49 |
| 6,393,228 | B1 | * | 5/2002 | Hisano | 399/49 |
| 2002/0159791 | A1 | | 10/2002 | Chen et al. | 399/167 |
| 2003/0016960 | A1 | * | 1/2003 | Stelter et al. | 399/49 |
| 2003/0128993 | A1 | * | 7/2003 | Mitsuya et al. | 399/49 X |
| 2003/0142985 | A1 | | 7/2003 | Sampath et al. | 399/9 |

FOREIGN PATENT DOCUMENTS

| | | | |
|---|---|---|---|
| JP | 03-043773 | A * | 2/1991 |
| JP | 05-134561 | A * | 5/1993 |
| JP | 05-241403 | A * | 9/1993 |
| JP | 05-257352 | A * | 10/1993 |
| JP | A 6-11929 | | 1/1994 |

* cited by examiner

*Primary Examiner*—Sophia S. Chen
(74) *Attorney, Agent, or Firm*—Oliff & Berridge, PLC

(57) ABSTRACT

A system and method of determining a residual toner mass on a receiving member includes providing one or more test patterns to the receiving member, transferring the test patterns from the receiving member to a transfer medium, determining a sensor signal obtained after transfer, processing the sensor signal obtained after transfer and determining an amount of residual toner mass based on the processed sensor signal. A xerographic marking device also includes a receiving member, an array-type optical sensor or a point optical sensor arranged on the receiving member, and a controller that generates one or more test patterns, transfers the test patterns to a transfer medium, determines a sensor signal obtained after the transfer by the optical sensors, processes the determined sensor signal, and determines an amount of residual toner mass based on the processed sensor signal.

27 Claims, 17 Drawing Sheets

METHOD AND APPARATUS FOR CONTROLLING NON-UNIFORM BANDING AND RESIDUAL TONER DENSITY USING FEEDBACK CONTROL

BACKGROUND OF THE INVENTION

1. Field of Invention

This invention is directed to implementing a feedback control loop for correcting non-uniform banding print quality defect. This invention is also directed to using array sensors and other point sensors for measuring banding and transfer efficiency in printing operations.

2. Description of Related Art

A common image quality defect introduced by the copying or printing process is banding. Banding generally refers to periodic defects on an image caused by a one-dimensional density variation in the process (slow scan) directions. An example of this kind of image quality defect, or periodic banding, is illustrated in FIG. 1. Bands can result due to many xerographic subsystem defects. Examples of these defects are run-out in the developer roll or photoreceptor drum, wobble in the polygon mirror of the laser raster optical scanner (ROS), and periodic variations in the photoreceptor motion, and the like. The sensitivity of print quality to these parameters can also depend on other factors. For example, the sensitivity of print quality to developer roll run-out depends largely on the age of the developer in semiconductive magnetic brush development. The problem of banding defect is generally addressed by focusing on mechanical design such as, for instance, maintaining tight tolerances on developer roll run-out, open loop operation, and the like.

Feedback controls were also introduced as a means to mitigate banding. Using a feedback control approach enables the use of components with relaxed tolerances, which would reduce unit machine cost (UMC). Also, controller design could be easily scaled from one product to the next. Moreover, feedback control is inherently robust to subsystem variations, such as developer material variations. The key shortcoming of this approach is that the banding defects are assumed to be uniform in the cross-process direction, as illustrated in FIG. 1.

However, banding is generally not uniform in the cross-process direction. In particular, developer roll run-out can give rise to banding that is not uniform. FIG. 2 illustrates typical profiles of developer roll run-out, and FIG. 3 shows examples of non-uniform banding associated with these roll run-out profiles. In FIG. 3, X refers to the cross-process direction and Y refers to the process direction. In the case of uniform banding, density variations are only a periodic function of the process direction position Y. That is, for a fixed value of Y, the density is constant in the X-direction, i.e., the cross-process direction. However, this case would only occur if the developer roll was only out of round, i.e., was not perfectly round, as illustrated in FIG. 3*a*. In the case of non-uniform banding, density variations are not only periodic in the process direction Y, but are a function of the cross-process direction X as well. For instance, banding due to bowing, and to the combination of both conicity and roundness are examples of non-uniform banding, and are illustrated in FIGS. 3*b* and 3*c*, respectively. For these banding examples, the density variations in the X-direction for a fixed Y position are qualitatively shown in FIG. 4, which relates developed mass average (DMA) with respect to the cross-process direction X. For both uniform and non-uniform banding, a typical density variation in the process direction Y, for a fixed X-coordinate, is shown in FIG. 5.

Another problem occurring in print and copy operations is high frequency banding. High frequency banding is a periodic modulation of a print with closely spaced peaks and troughs that run in the process direction. The peaks and troughs are so closely spaced that toner area coverage sensors using an illumination spot of a few millimeters in diameter cannot resolve the peaks and troughs. A primary cause of high frequency banding is, for instance, defect in the laser Raster Optical Scanner (ROS). These defects might include wobble in the ROS polygon mirror as it rotates, variations in the facet reflectivity, or errors in alignment of multibeam ROS's. Other subsystems, such as wire vibration in hybrid scavengeless development, may also contribute to high frequency banding. Accordingly, elimination of these defects has required manufacturing these systems and subsystems to high precision and at higher costs.

Another problem associated with print quality in print and copy operations is incomplete transfer of the toner image from the photoreceptor or from the intermediate belt to the paper. Because of some strongly adhering toners to the photoreceptor, low charge toner, air breakdown, or other reason, the transfer of the image from the photoreceptor to the intermediate transfer belt or paper, or from the intermediate transfer belt to the paper, will be incomplete. If the efficiency of transfer of the toner varies significantly from 100%, the density of toner on the final image may change. If the images are colored images, then changes in the density of toner will result in color shifts. Presently, printers are designed to have some latitude against variations in the external noises that cause transfer failures and these designs come at some cost.

An alternative approach, if the change in transfer efficiency can be detected before any image quality change occurs, is to adjust transfer subsystems set points to maintain a high transfer efficiency. Generally, the transfer efficiency can constantly be monitored in order to control the transfer efficiencies throughout and regardless of the various noises occurring in the xerographic process. However, to implement this approach, a sensitive measure of the toner residual mass must be made. Currently, a conventional sensor of toner mass on a photoreceptor is generally a toner area coverage (TAC) sensor. The TAC sensor monitors the change in the reflected light that the presence of toner on a photoreceptor causes. However, the TAC sensor is not accurate at low mass coverages. The background signal of the photoreceptor undergoes drifting due to, for example, the structure of the photoreceptor surface, variations in the illumination source, contaminants on the photoreceptor, and other noise sources. This drifting can dominate any small change the presence of a low area coverage of residual mass may cause, which may cause the low area coverage to remain undetected.

The detection of toner at very low coverages, such as for example of coverages smaller than 0.005 mg/cm$^2$, can be important in diagnosing failures in the xerographic process. Accordingly, a technique for detecting low levels of toner is particle counting. This technique consists in submitting a small region of the surface of the photoreceptor to a microscope at a magnification such that the toner particles can be resolved. The number of toner particles over a given area is counted, either manually or automatically with a digital processing software, and the mass of toner present on the surface is inferred from the known density of the toner and the size of the toner particles. However, this technique is time-consuming and cannot be incorporated into the control system of a printer.

SUMMARY OF THE INVENTION

In light of the above described problems and short comings, various exemplary embodiments of the systems and methods according to this invention provide a feedback control method and system of controlling banding on a receiving member in an imaging or printing process is disclosed, comprising determining a toner density on the receiving member, automatically determining the extent of banding on the receiving member by comparing the determined toner density to a reference toner density value, and automatically adjusting the toner density based on a result obtained from the comparison of the measured toner density to the reference toner density value.

Moreover, a method and system of determining banding on a xerographic marking device is disclosed, comprising creating at least one test pattern, imaging the at least one test pattern, determining a signal obtained during imaging of the at least one test pattern by optical sensors arranged on a photoreceptor, processing the signal obtained during imaging, and determining an amount of banding based on the processed signal.

Also, a method and system of determining a residual toner mass on a receiving member is disclosed, comprising generating one or more test patterns, transferring the one or more test patterns from the receiving member to a transfer medium, determining a sensor signal obtained after transferring of the one or more test patterns by optical sensors arranged on the receiving member, processing the sensor signal obtained after transferring, and determining an amount of residual toner mass based on the processed sensor signal.

Finally, a xerographic marking device is disclosed, comprising at least one of an array-type sensor and point sensors, at least one electromechanical actuator, and/or at least one exposure actuator, an input device and a controller.

BRIEF DESCRIPTION OF THE DRAWINGS

Various exemplary embodiments of the systems and methods of this invention will be described in detail, with reference to the following figures, wherein.

DETAILED DESCRIPTION OF PREFERRED EMBODIMENTS

These and other features and advantages of this invention are described in, or are apparent from, the following detailed description of various exemplary embodiments of the systems and methods according to this invention.

According to various exemplary embodiments of this invention, a closed loop controlled strategy is disclosed in order to address the problems of non-uniform banding defects discussed above. Mitigating non-uniform banding defects is done, according to various exemplary embodiments, by first determining the non-uniform banding defects in the developed image on the receiving member using a variety of sensors, then altering the printing parameters to eliminate the defects. In various exemplary embodiments, the receiving member can be the photoreceptor, the intermediate belt or the sheet of paper. The sensors used to determine the non-uniform banding defects are, according to various exemplary embodiments, multiple ETAC sensors or other point sensors such as, for instance, total area coverage (TAC) sensors. According to various exemplary embodiments, the sensors are array-type sensors such as, for instance, full-width array (FWA) sensors, and the like.

According to various exemplary embodiments, the sensors actuate an electromechanical actuator such as, for instance, a developer roll voltage $V_{dev}(t)$ and an exposure actuator such as, for instance, a LED or ROS intensity ROS (x, t), where x is a coordinate in the cross-process direction and t is time, using a feedback control loop. More specifically, the developer voltage, according to various exemplary embodiments, is used as a coarse actuator to remove the mean banding level, and the ROS intensity or LED intensity is used as a fine actuator to remove the non-uniformity in the banding.

Figure 1:
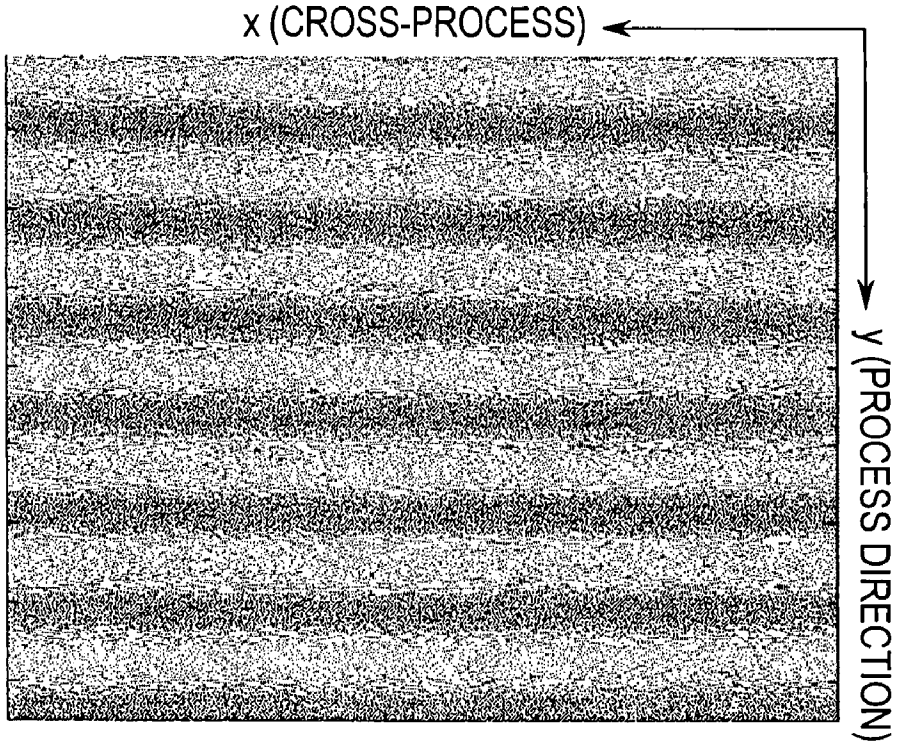
FIG. 1 shows an example of uniform banding.
Figure 2C:
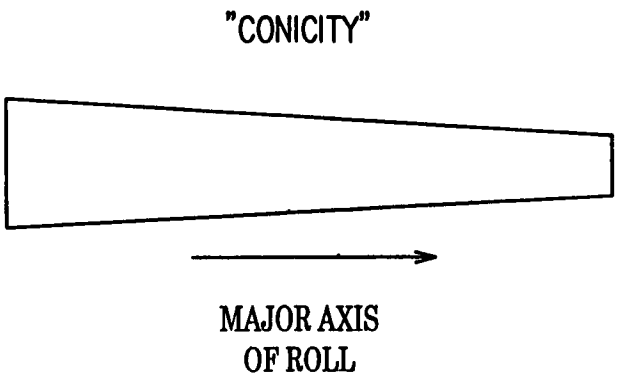
FIGS. 2*a–c* illustrate typical developer roll run-out profiles.
Figure 2B:
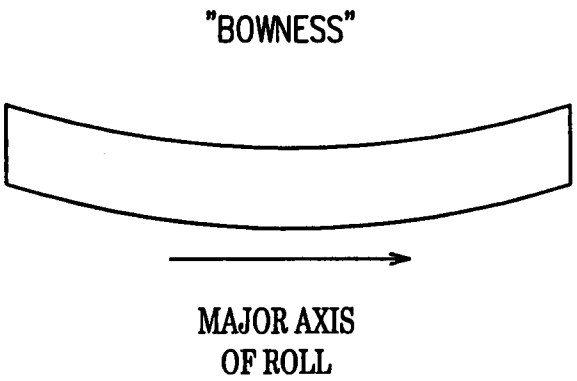
Figure 2A:
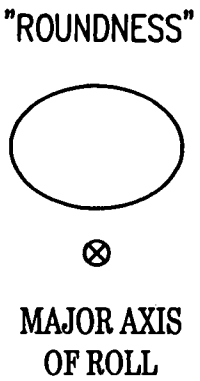

In typical developer housings, the developer roll voltage ($V_{dev}$) can only be adjusted as a function of time, that is in the process direction only and cannot be varied in the cross-process direction. Accordingly, the developer roll voltage can only influence uniform banding by removing some amount of banding along the process direction. For instance, ($V_{dev}$) can lighten the dark lines shown on FIG. 1. In this approach, the developer roll voltage may be used as a one-dimensional actuator.

Figure 3C:
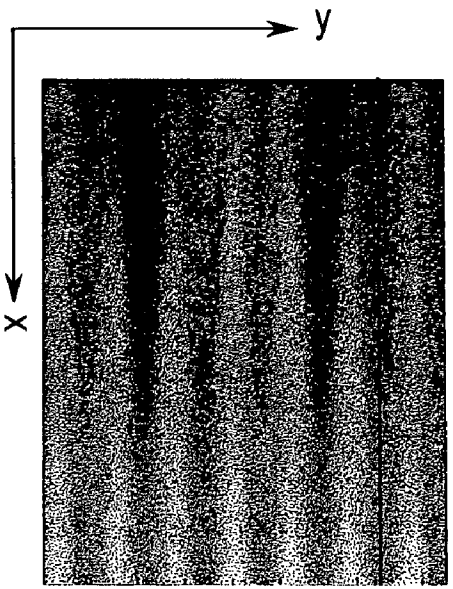
FIGS. 3*a–c* show different types of banding defects resulting from the developer roll run-out profiles of FIGS. 2*a–c;*
Figure 3B:
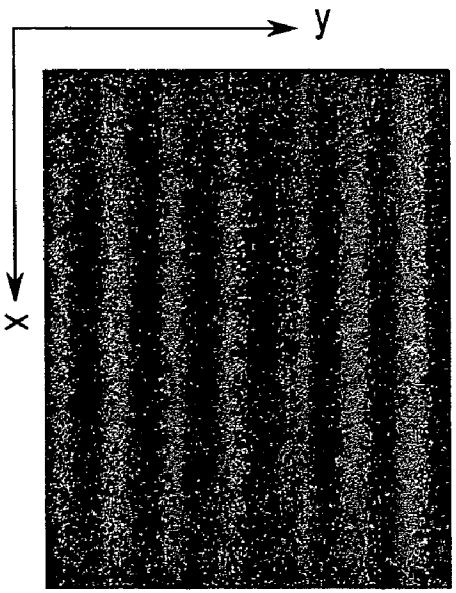
Figure 3A:
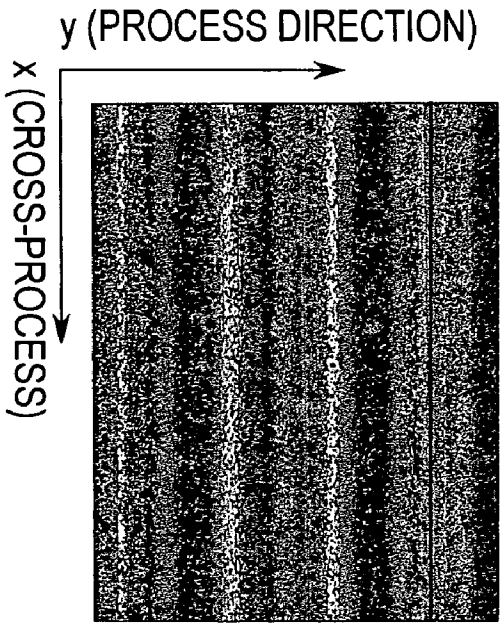

On the other hand, according to various exemplary embodiments, the ROS intensity or LED intensity can be adjusted in both the cross-process direction (within a scan line) and in the process direction (scan line to scan line). Hence, the ROS intensity can also remove both uniform and non-uniform banding of the types illustrated in FIGS. 3*b* and 3*c*.

Utilizing both the developer roll voltage and the ROS intensity or LED intensity provides a wider range of closed-loop control opportunities because the developer roll voltage and the ROS intensity or LED intensity affect development in complementary ways. Accordingly, other artifacts that may occur as a result of the actuation of the ROS voltage alone, such as, for example, halftone interactions, highlight and shadow effects, and the like, may be avoided by first using the developer roll voltage ($V_{dev}$) to remove some of the uniform banding, then using ROS intensity to remove both uniform and non-uniform banding. Moreover, this multi variable approach, i.e., developer roll voltage and ROS intensity or LED intensity, provides more opportunities for optimizing multiple metrics which may include print quality performance as well as disturbance rejection performance and component design latitudes.

Figure 6B:
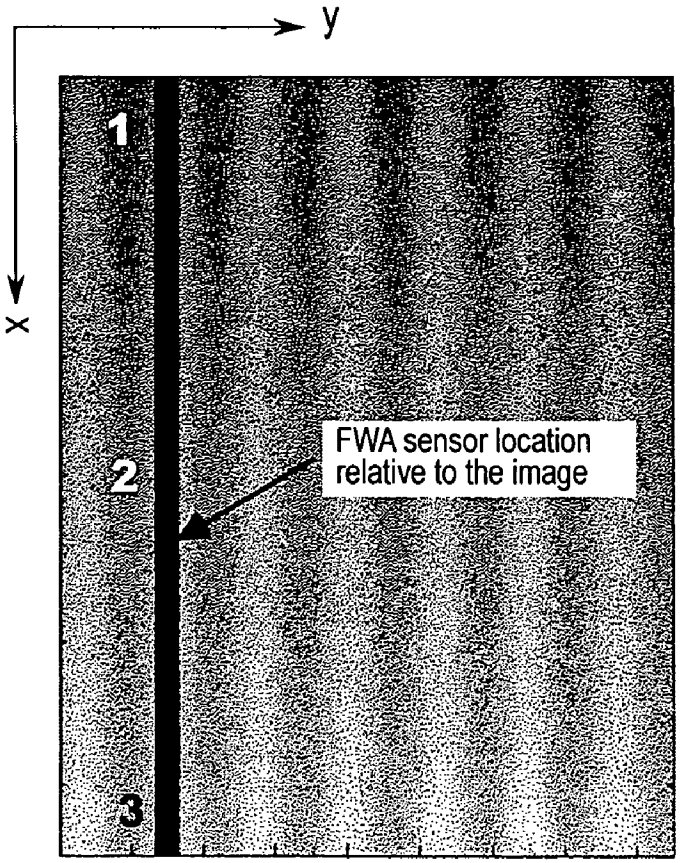
FIGS. 6*a–b* illustrate various exemplary embodiments of potential sensor arrangements for measuring non-uniform banding.
Figure 6A:
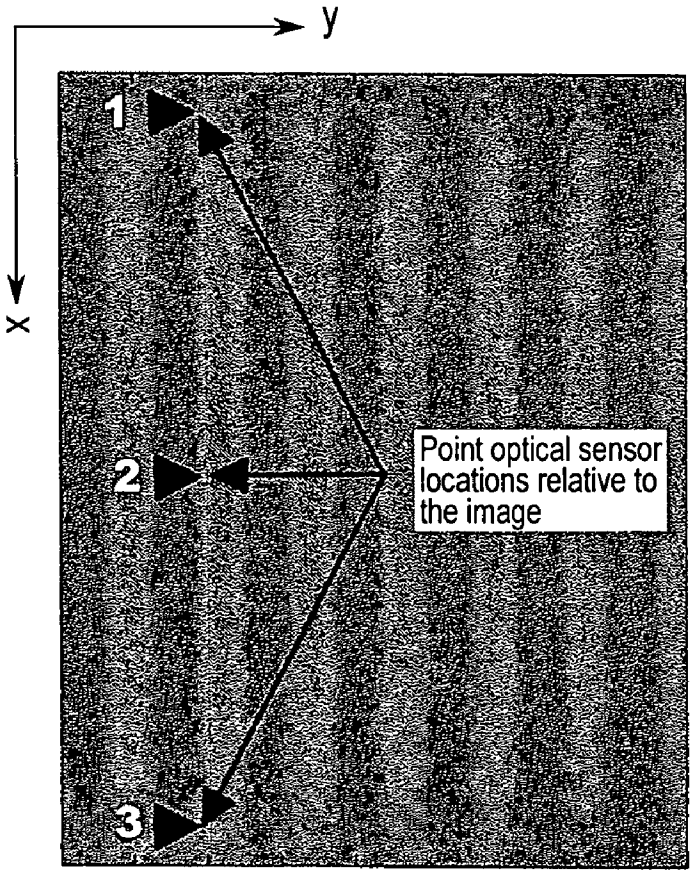

FIGS. 6*a–b* illustrate various exemplary embodiments of potential sensor arrangements for detecting non-uniform banding in a developed image. In FIG. 6*a,* multiple optical point sensors are distributed along the cross-process direction x of an element, according to various exemplary embodiments. In various exemplary embodiments, the element can be a photoreceptor belt or drum or an intermediate belt or drum.

In various exemplary embodiments, the optical sensors include ETAC sensors. In this approach, detection of measuring the non-uniform banding may be performed by the density of toner at a discrete number of points 1–3 along the cross-process direction (x) of the receiving member, and then interpolate the density measurements to estimate the density of toner at other locations along the cross-process direction x. These measurements can then be repeated at regular intervals along the process direction (y) in order to assess the periodicity of the banding.

Figure 4:
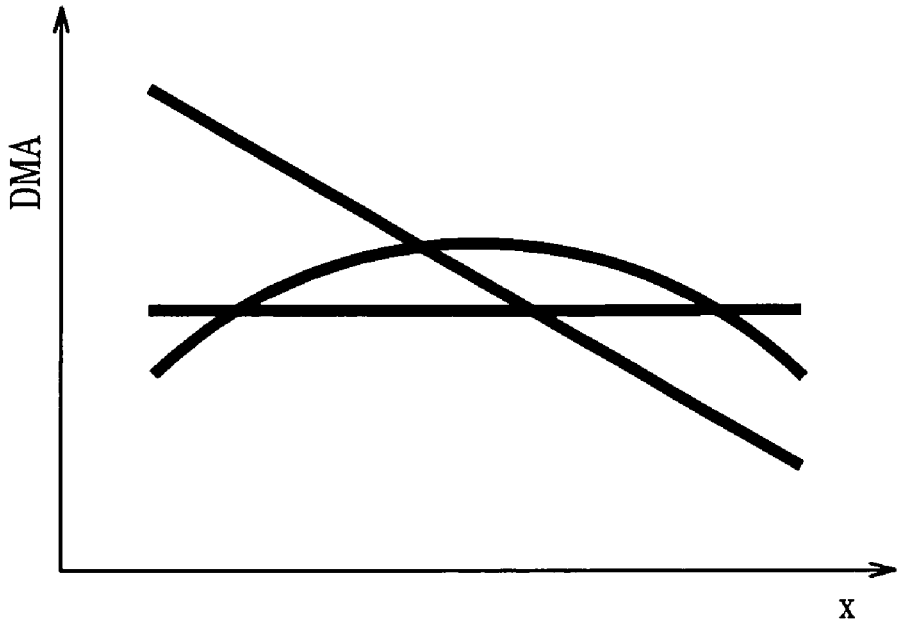
FIG. 4 illustrates the amplitude of the density variations along the cross-process direction for different types of banding defects shown in FIGS. 3*a–c;*
Figure 5:
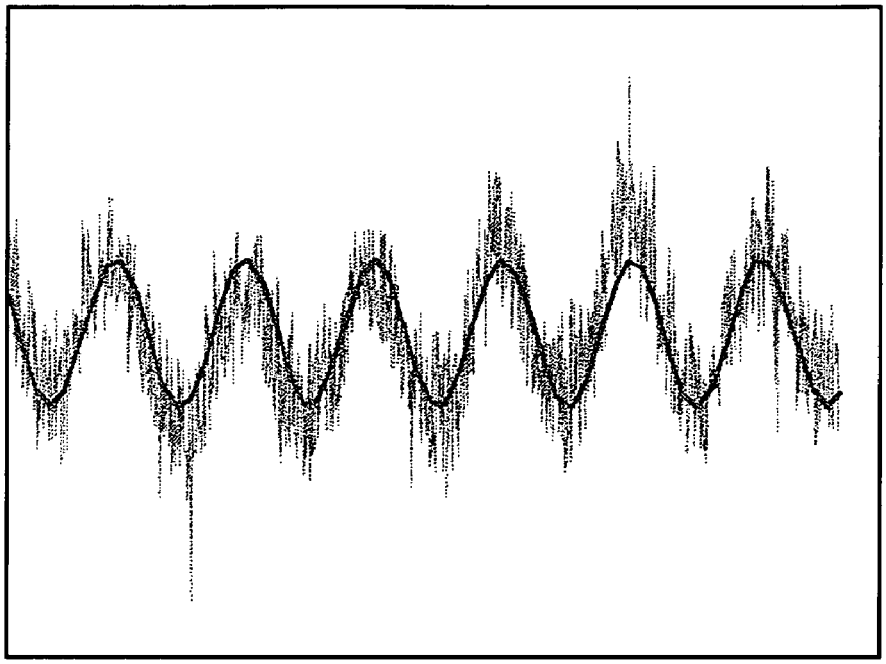
FIG. 5 illustrates a typical density variation in the process direction in uniform banding.

FIG. 4 graphically illustrates the amplitude of the density variations along the cross-process direction for different types of banding defects. The graphs on FIG. 4 suggest that the cross-direction density variations amplitude may be modeled by a function quadratic in x, x being the distance in the cross-process direction. Based on this modeling assumption, the case, at least three ETAC sensors may be employed, according to various exemplary embodiments, to generate the data for estimating the coefficients in such a quadratic function. FIG. 6*a* illustrates exemplary locations where the three ETAC point sensors may be positioned.

FIG. 6*b* illustrates how an array-type sensor, such as, for instance, a full-width array (FWA) sensor can be used according to various exemplary embodiments, to detect the non-uniform banding in the process direction y of the element. In various exemplary embodiments, the element can be a photoreceptor, an intermediate belt or a printed piece of paper. An advantage of the FWA sensor approach compared to the point sensor approach, according to various exemplary embodiments, is that many more measurements of toner density in the cross-process direction x are available, which eliminates interpolation errors in the case where the non-uniform banding is not strictly quadratic.

Figure 7:
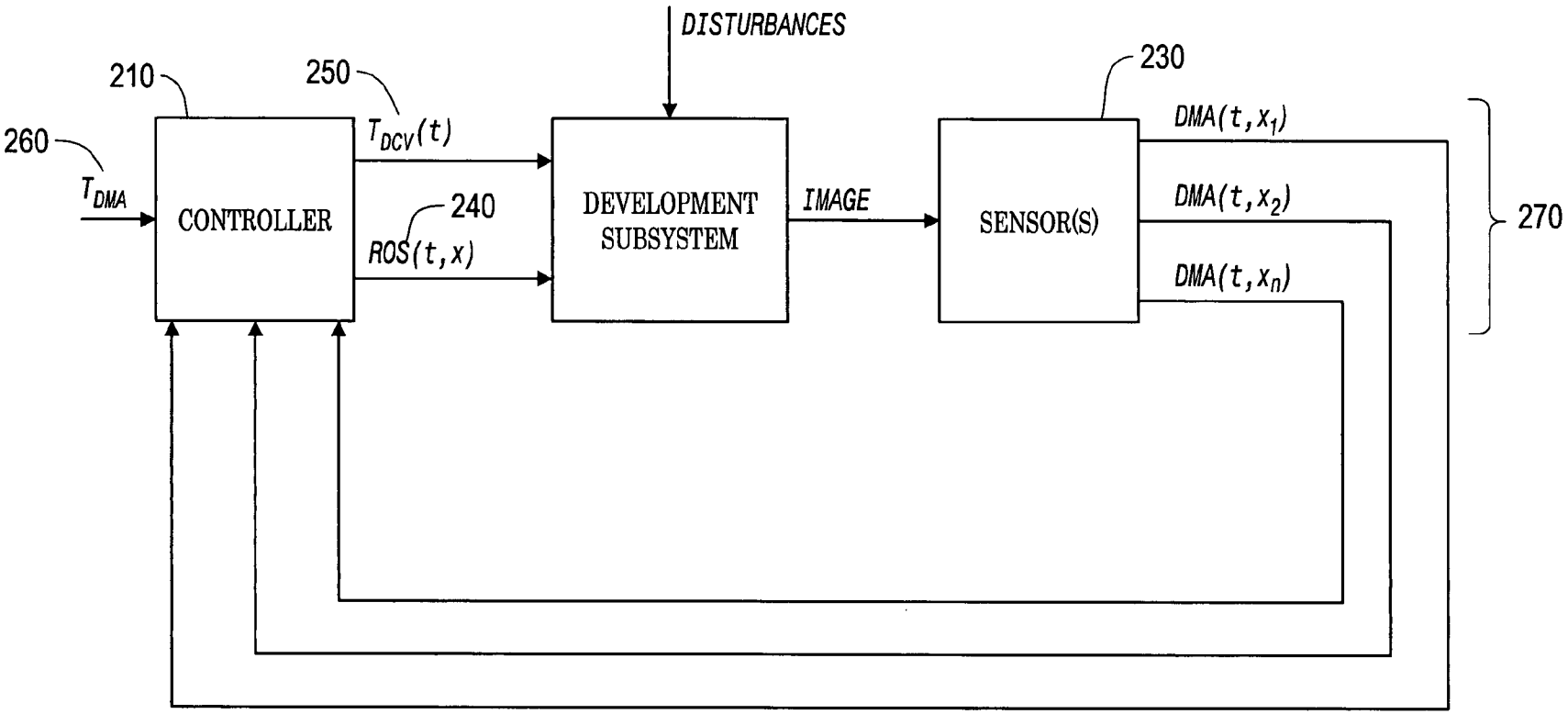
FIG. 7 illustrates an exemplary embodiment of a feedback loop control strategy for removing banding in an image.

FIG. 7 illustrates the general feedback control topology, according to various exemplary embodiments, that maps the detected level of banding to actuator commands that control $V_{dev}$ 250 and ROS 240. In FIG. 7, $T_{DMA}$ 260 is the target value for the developed mass average DMA (t, $x_i$) 270, which is the sensed DMA by sensor 230 at time t in a location $x_i$, where i is the index of the point sensors in the case of the point sensor (ETAC) approach, or i is the index of a pixel of the FWA sensor in the case of the FWA sensor approach. $T_{DMA}$ 260 is input to controller 210.

According to various exemplary embodiments of this invention, a feedback control scheme is to use the development roll voltage $V_{dev}(t)$ 250 as a coarse actuator in order to remove the mean uniform banding level, i.e., the cross-reference direction, and then use the ROS intensity 240 as a fine actuator in order to remove both uniform and non-uniformity banding. In this approach, according to various exemplary embodiments, the development roll voltage 250 is selected to mitigate banding at one particular sensor location in the cross-process direction x. The general form of the ROS intensity actuation 240, according to various exemplary embodiments, is:

$$ROS(t, x_i)=C(T_{DMA}, DMA(t, x_i), V_{dev}(t)), \tag{1}$$

where C refers to the controller. In the space between the sensor locations, the ROS intensity is interpolated as follows:

$$ROS(t, x)=\theta^T(t)f(x), \tag{2}$$

where θ is a p-dimensional vector of unknown coefficients that are possibly a function of position in the process direction, f is a p-dimensional vector of basis functions for the interpolation, and the superscript T refers to the transpose operation.

A specific example of interpolation for this approach is:

$$ROS(t, x)=(\theta_1+\theta_2x+\theta_3x^2)*\alpha*V_{dev}(t), \tag{3}$$

where α is a scaling parameter that converts the development voltage $V_{dev}(t)$ 250 into "ROS-like" intensity units. For the specific example in equation 3, the idea is to have the ROS 260 vary with respect to the developer roll voltage $V_{dev}$ 250. That is, the periodicity of the ROS intensity 260, i.e., the scan-line-to-scan-line variation is set by the developer roll voltage $V_{dev}$ 250, while the variation of ROS intensity 260 within a given scan line is set by the quadratic interpolation function given in parenthesis. In this case, $$\begin{bmatrix}\theta_1\\ \theta_2\\ \theta_3\end{bmatrix}*\alpha*V_{dev}(t), \text{ and } f(x)=\begin{bmatrix}1\\ x\\ x^2\end{bmatrix} \tag{4}$$

the basis functions for this exemplary embodiment were chosen because the density variations illustrated in FIG. 4 may be captured by a quadratic function. For other, perhaps more complicated, density variation patterns, alternate basis functions can be used.

It should be noted that, in equation 4, the t dependence in θ comes from the scaled development roll voltage $V_{dev}$ 250. The remaining unknown θs can be estimated through an identification experiment conducted within the machine. For the identification experiment, a test pattern may be developed and measured in-situ using the sensing strategy described above, and a simple least-squares fit to the data may be used to provide estimates of the θs.

An example of a feedback control law to go along with the specific interpolation approach presented in equation 3 is as follows:

$$ROS(kN, x_i)=ROS((k-1)N, x_i)+K^i_{ROS}*(T_{DMA}-DMA((k-1)N, x_i)) \quad (5)$$

where N is the sampling period, k represents a time index and $K^i_{ROS}$ is the gain of the controller, which determines how much the ROS changes form one update to the next.

Figure 8:
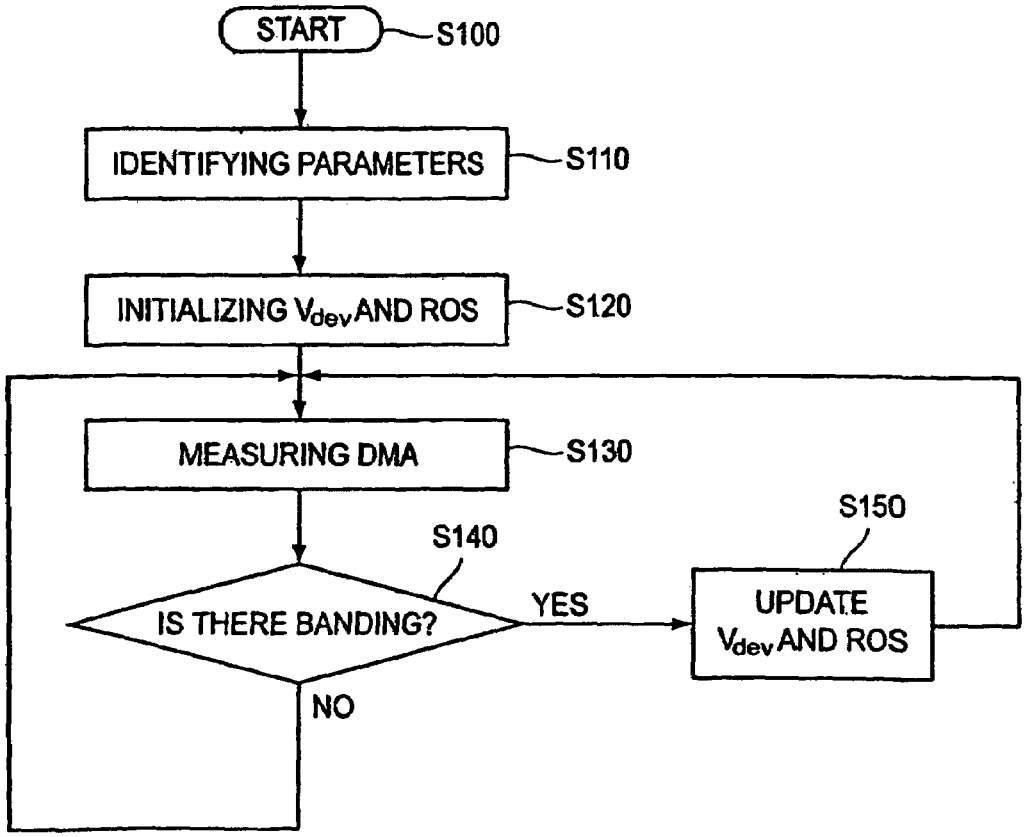
FIG. 8 is a flowchart of an exemplary embodiment of a method of establishing the parameters of the feedback control loop for banding control.

FIG. 8 is a flowchart of various exemplary embodiments of a method of establishing the parameters of the feedback control loop. According to various exemplary embodiments, the method includes establishing the θs by performing an identification experiment on a test pattern that is known to be sensitive to banding such as a uniform halftone determining $V_{dev}$, initializing the ROS intensity using equation 3, updating the ROS intensity and ($V_{dev}$) correction using equation 5, and updating the ROS interpolation using the new ROS values at the sensor locations computed previously.

According to FIG. 8, establishing the feedback control loop starts at step S100. Next, during step S110, the parameters θ, as illustrated in equations 2–4 and explained above, are identified by using a known pattern and measuring the resulting developer roll voltage ($V_{dev}$) or full-width amplitude (FWA) signal. When the test pattern is measured, a least squares fit to the resulting data may be used to provide estimates of the parameters θ, thus setting up equations 1–4. Next, once the parameters θ are identified during step S110, control continues to step S120.

During step S120, both the developer roll voltage ($V_{dev}$) and the ROS intensity are initialized and an image is produced. Next, control continues to step S130. During step S130, developer mass average (DMA) is measured at the different sensor locations. Next, control continues to step S140.

During step S140, the controller determines whether there is a large amount of banding. A large amount of banding is a variation which a typical consumer of the product, upon viewing an image of a uniform area, would notice the banding to be objectionable. If a large amount of banding is determined, then control continues to step S150. During step S150, the ROS intensity and the developer roll voltage ($V_{dev}$) are configured, i.e., updated so as to reduce the amount of banding determined. Following step S150, control goes back to step S130 in order to measure the resulting DMA at the different sensor locations.

If a large amount of banding is not determined, then control jumps back to step S140. During step S140, the controller determines again whether there is a large amount of banding.

In various exemplary embodiments, the above-described feedback control loop can be coupled to the ability to measure small amounts of toner on either the photoreceptor, the intermediate belt, or the printed piece of paper. Accordingly, in various exemplary embodiments, methods of determining amounts of toner are disclosed.

A method of measuring the mass of residual toner on a surface, according to various exemplary embodiments of this invention, includes monitoring the change in the reflection of light caused by the toner through the signal generated by ETAC sensors. The ETAC signal has noise superimposed upon it. The noise is a combination of measurement noise and noise from the structure of the surface being measured. The noise typically sets a lower limit of the toner mass that can be detected with it and limits its use to detect untransferred toner. The ETAC illuminates the photoreceptor surface with a single wavelength of light at an angle to the surface. Both the specular signal and the diffuse signal of the reflected light can then be detected. A typical photoreceptor has a mirror surface, so the presence of the rough toner layer on it will decrease the amplitude of the specular signal and increase the amplitude of the diffuse signal.

Figure 9:
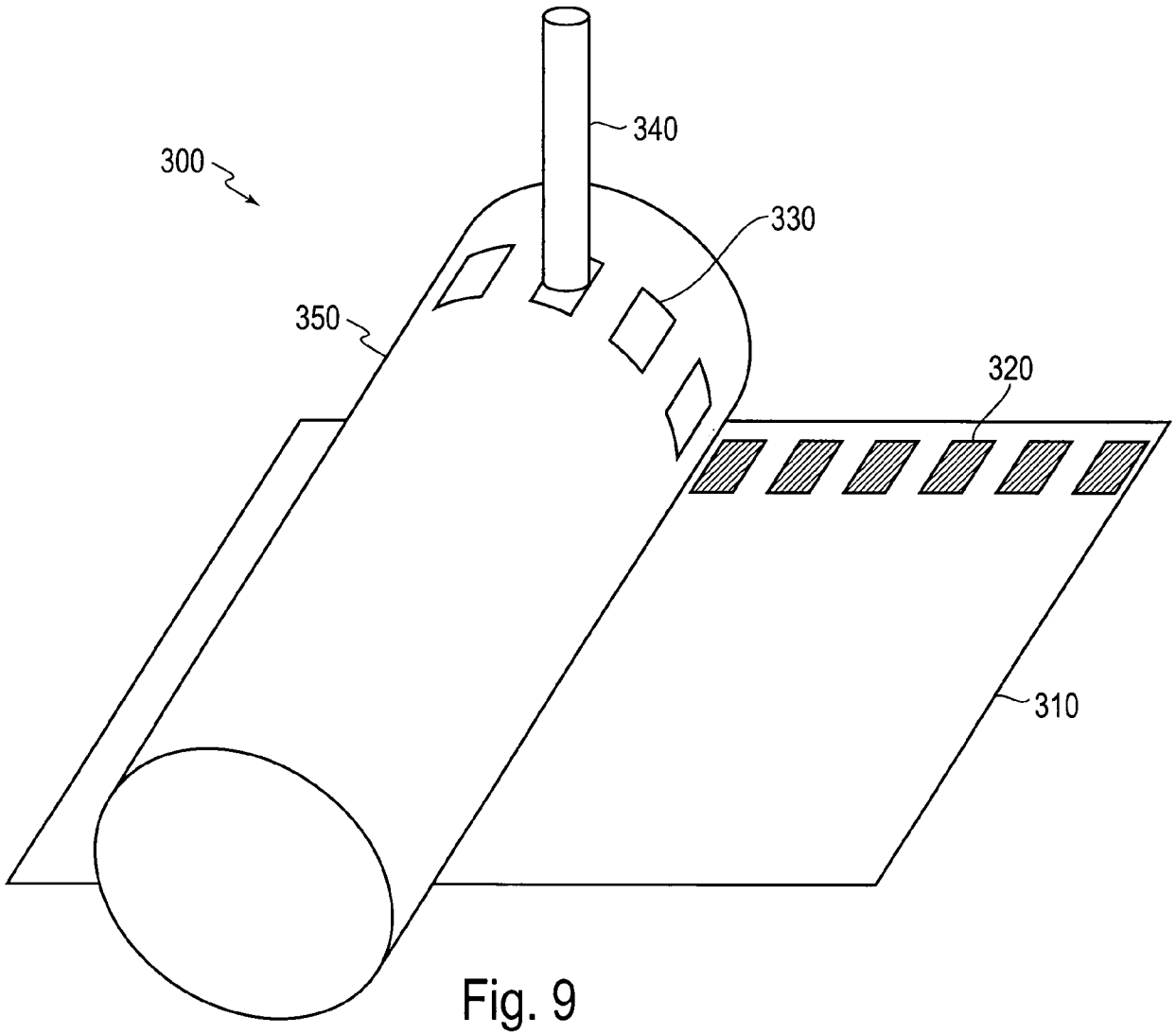
FIG. 9 illustrates the development of a series of patches to a receiving member, and transfer of the patches to a transferring member.

A test pattern consisting of a series of patches can be introduced to increase the sensitivity of a measurement of the residual mass. An example of one such test pattern 300, as illustrated in FIG. 9, consists of a series of residual patches 330 of a known length and spacing are developed to the photoreceptor 350, and transferred to paper 310, as shown by the transferred patches 320. A point optical sensor 340, such as, for instance, an ETAC sensor, measures the residual toner from each of the patches following transfer. In the absence of 100% transfer, the ETAC will respond to the patches. The response will be superimposed upon the noise of the ETAC.

FIG. 9 illustrates the development of a series of patches to a receiving member, and transfer of the patches to a transferring member. If the transfer is incomplete, residual patches will remain on the receiving member. If a point optical sensor is placed in the path of the residual patches, the point optical sensor will respond to the presence of the residual patches. According to various exemplary embodiment of this invention, the series of patches is transferred directly from the receiving member to the output substrate which is, for instance, paper.

Figure 10:
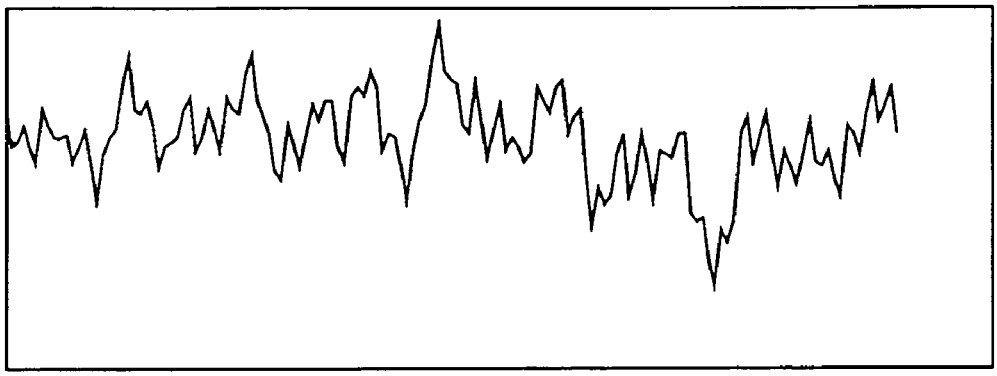
FIG. 10 illustrates the evolution of an ETAC specular reference signal as a function of process direction.

An exemplary embodiment of an ETAC specular reference signal is represented in FIG. 10, which describes the evolution of the ETAC response as a function of position in the process direction. The ETAC signal, as shown in FIG. 10, exhibits some periodicity, but the ETAC signal is generally noisy. However, if the transfer is less than 100%, there will be a superimposed periodic variation at the frequency of the test patches. There exists various signal processing techniques known to one skilled in the art to extract the amplitude of this variation.

One exemplary embodiment is to take the Fourier transform of the signal and extract the peak amplitude at the known frequency. Another technique is to average the ETAC signal over the area of the patches, and separately over the area between the patches. The difference between these two signals is proportional to the residual toner.

According to various exemplary embodiments of this invention, the ETAC signal can be used to detect masses ranging from approximately 0.5 milligram per square centimeter ($mg/cm^2$), which is greater than the full coverage of a typical photoreceptor, to about 0.005 $mg/cm^2$, which is about $100^{th}$ of the full coverage.

Figure 11:
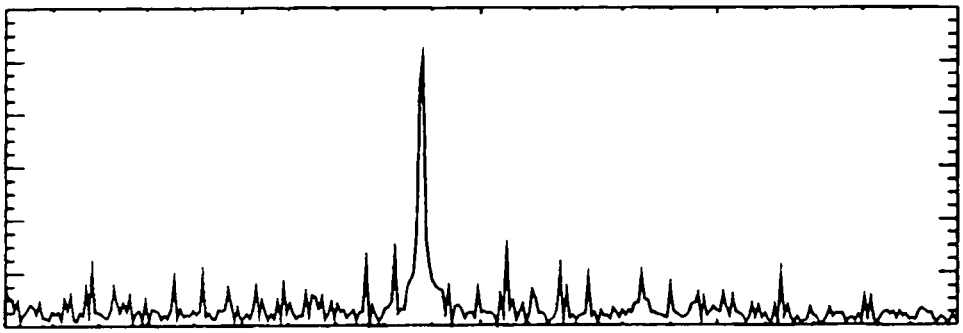
FIG. 11 represents the Fourier transform of the ETAC curve as a function of spatial frequency in the process direction.

FIG. 11 illustrates the Fourier transform of an ETAC signal according to various exemplary embodiments of this invention, wherein the specific frequency of the ETAC signal is shown. In the exemplary embodiment shown in FIG. 11, the patches were about 1.28 cm wide and the spacing between the patches was about the same amount. This leads to a specific frequency of the ETAC signal of about 0.039 cycles per millimeter.

The amplitude of the Fourier signal, or the signal resulting from another signal processing technique, at the frequency introduced by the patches is proportional to the amount of residual toner.

Figure 12:
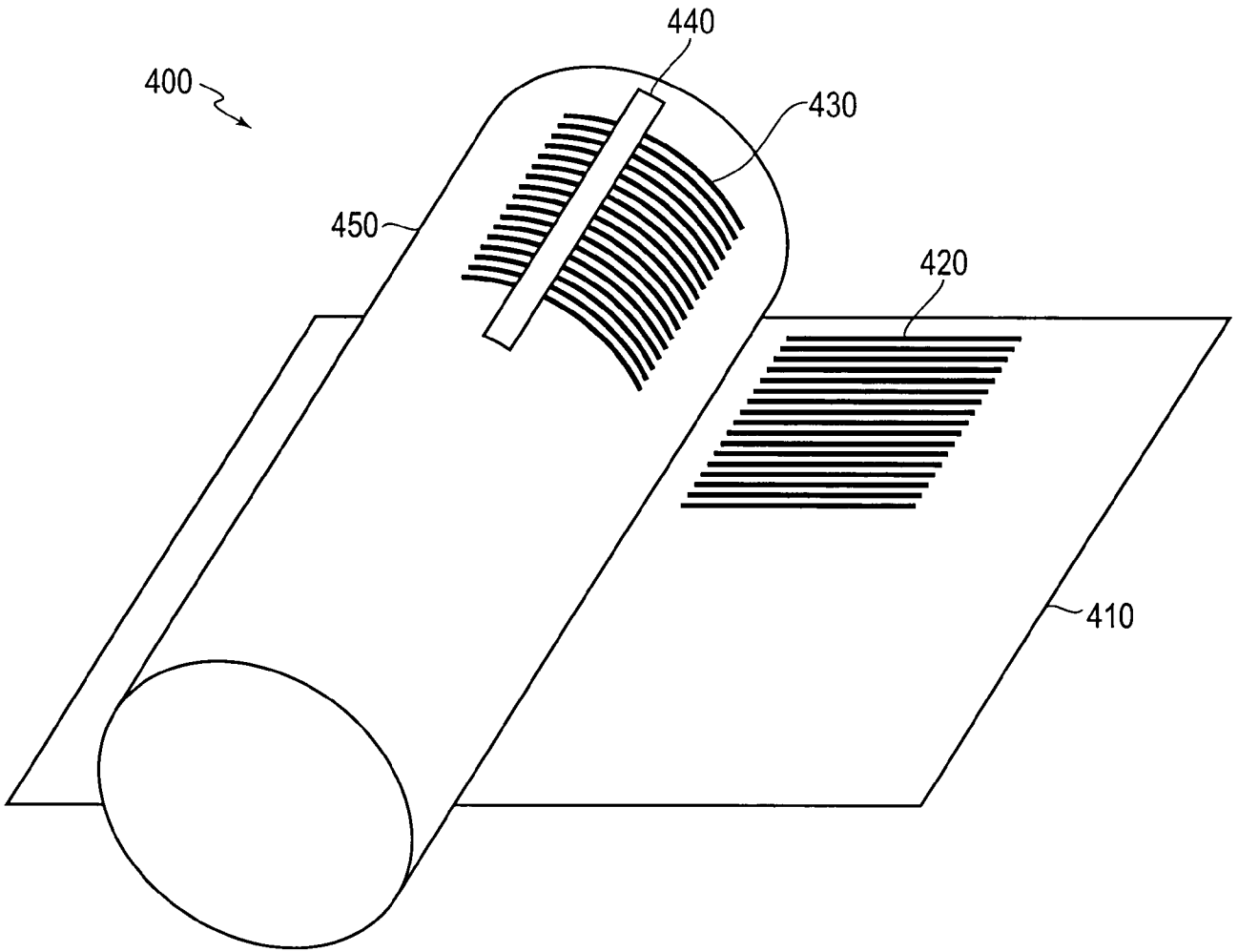
FIG. 12 illustrates the development of a series of parallel lines to a receiving member, and transfer the parallel lines to a transferring member.

FIG. 12 illustrates the development of a series of parallel lines to a receiving member, and transfer the parallel lines to a transferring member, as is shown by apparatus 400. If the transfer to the paper 410 is incomplete, a residual image 420 of the parallel lines will remain on the receiving member 450. If an array sensor 440, such as, for instance, a FWA sensor, is placed in the path of the residual parallel lines 430, the array sensor will collect a faint image of the residual parallel lines 430.

Figure 13A:
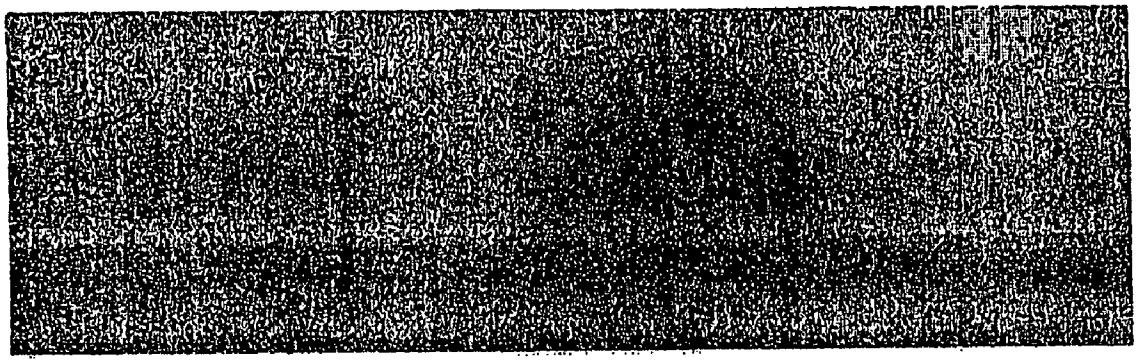
FIGS. 13*a–b* illustrate exemplary embodiments of a banding pattern and its resulting Fourier transform.
Figure 13B:
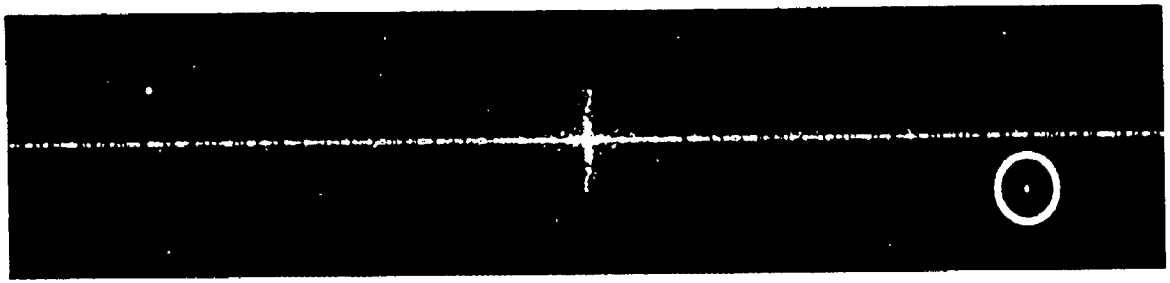

FIG. 13*a* illustrates such a transformation from a frequency time varying to a spatially varying signal using an array type pattern. FIG. 13*b* illustrates the Fourier transform of the FWA pattern illustrated in FIG. 13*a*, and determines the amplitude of the known frequency of variation on the pattern illustrated in FIG. 13*a*.

Figure 14:
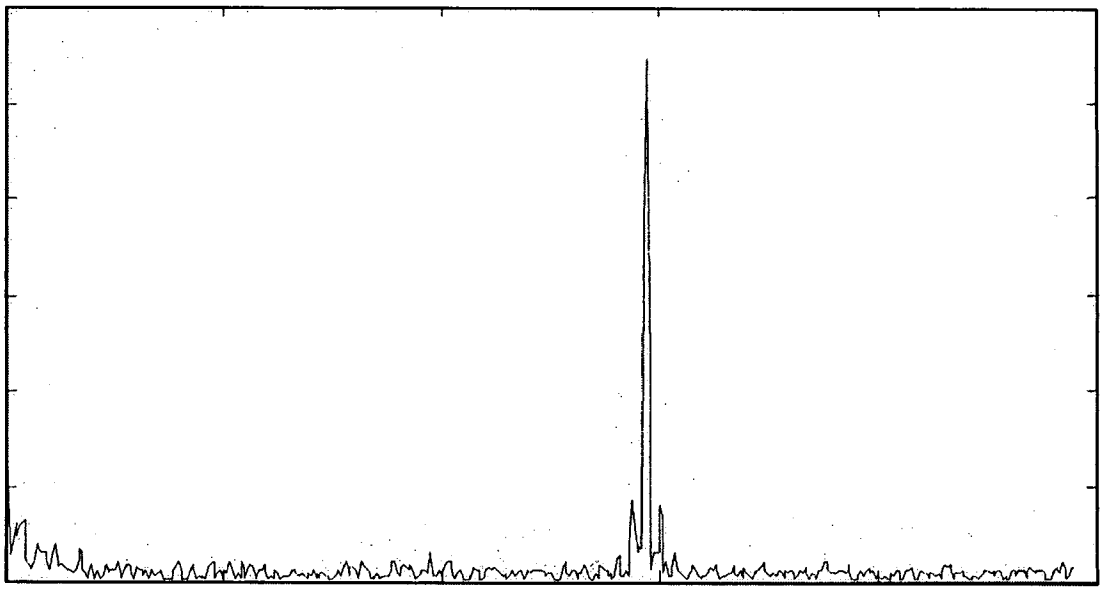
FIG. 14 illustrates an array based image of a receiving member over a simulated residual mass image and its resulting two-dimensional Fourier transform.
Figure 14:
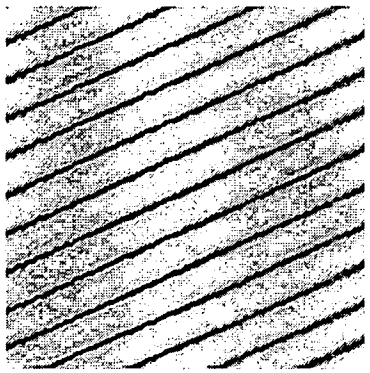

FIG. 13*b* illustrates the Fourier transform calculation based on the FWA signal. The amplitude of the known banding vibration peak obtained by the Fourier transform is then calculated, then, based on the calibration of the FWA sensors, the amount of residual mass, also called fractional area coverage, can be calculated. FIG. 14 illustrates on top an array-based image of a receiving member over a simulated residual mass image, and in the bottom its resulting two-dimensional Fourier transform. The circled illuminated point indicates the frequency and amplitude of banding vibration.

Figure 15:
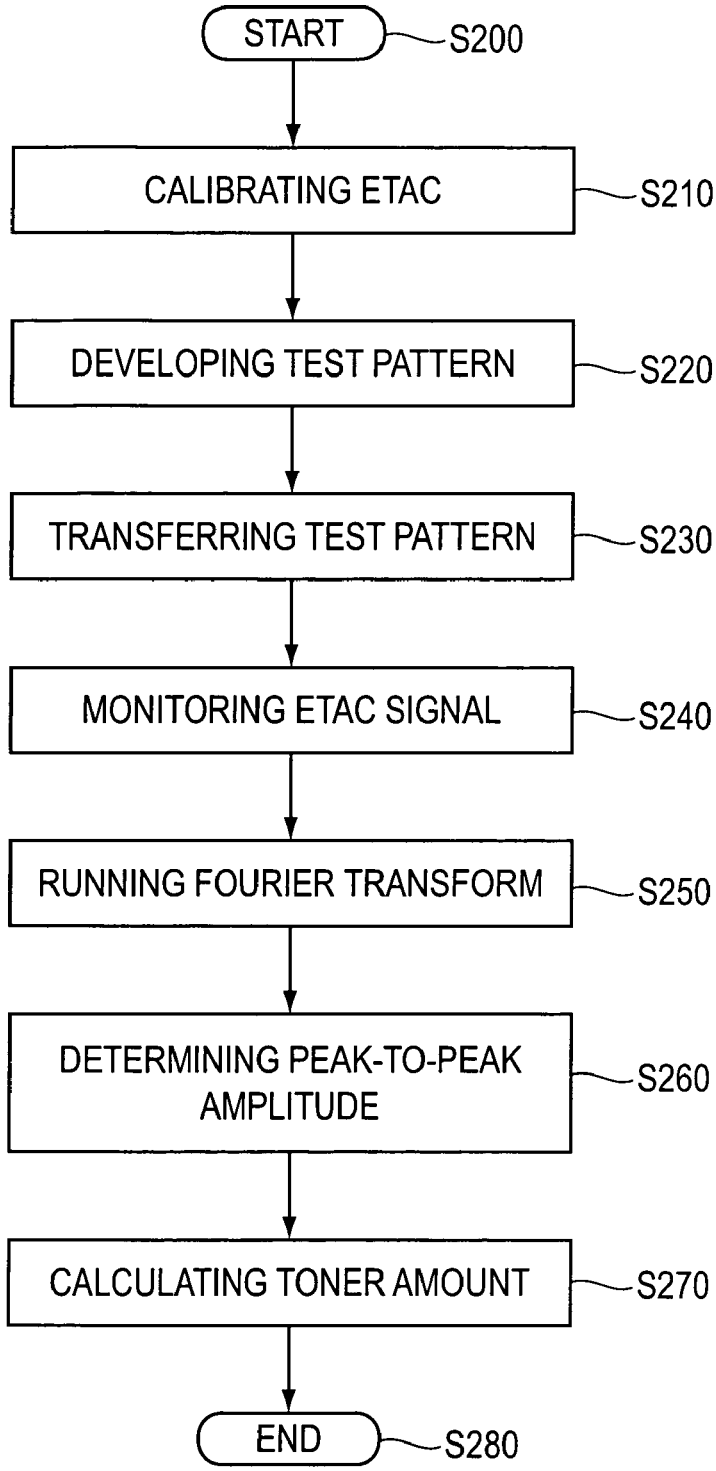
FIG. 15 is a flowchart of an exemplary embodiment of a method of determining residual amounts of toner using ETAC sensors.

FIG. 15 is a flowchart illustrating a method of determining a residual amount of toner using ETAC sensors according to various exemplary embodiments of this invention. The method starts at step S200, and continues to step S210. During step S210, the ETAC sensors are calibrated in order to determine the correspondence between the ETAC signal and the mass toner that a given ETAC signal corresponds to.

Once the calibration is performed, the average peak-to-peak amplitude of the signal, which is an ETAC signal extracted from the inverse Fourier transform, is compared to the calibrated values obtained for the ETAC. As such, a precise measure of very small amounts of toner can be determined.

For example, in various exemplary embodiments of this invention, a calibration of the ETAC sensor(s) yielded that a voltage swing (peak-to-peak amplitude) of 2.1 volts corresponds to a mass of 0.134 mg/cm$^2$ of toner on the photoreceptor. In the same example, the average peak-to-peak amplitude of an ETAC measurement is 0.0625 volts. Accordingly, the 0.0625 volts ETAC signal indicates that 0.00399 mg/cm$^2$ of toner was left on the photoreceptor, hence was untransferred. Accordingly, transfer efficiency, which is the ratio of untransferred toner to transferred toner, may be calculated. This technique can be effectively used to calculate transfer efficiency of toner.

When calibration is complete in step S210, control continues to step S220. During step S220, a series of patches are developed with a predefined width and spacing. For instance, patches may be developed with a width of approximately 1.25 cm and separated by gaps of approximately 1.25 cm. Next, during step S230, the patches are transferred from the photoreceptor to paper. When the transfer is complete during step S230, control continues to step S240.

During step S240, the ETAC signal measured from the photoreceptor as the transferred patches pass under the ETAC. This measured ETAC signal, during step S240, corresponds to the residual toner from the patches. When monitoring is complete during step S240, control continues to step S250.

During step S250, a Fourier transform is performed on the measured ETAC signal. Performing a Fourier transform on the ETAC signal allows the signal from the patches to be isolated from the noise. Once the Fourier transform is performed during step S250, control continues to step S260.

During step S260, an average peak-to-peak amplitude is determined from the Fourier transform calculated during step S250. When the peak-to-peak amplitude is determined, then control continues to step S270. During step S270, the amount of residual toner is calculated using a calibration curve that correlated ETAC response to the residual toner density. When the amount of residual toner is calculated during step S270, control continues to step S280, during which the method of measuring a residual amount of toner ends.

Moreover, array sensors can also be used to determine and/or measure low area coverage of toner on a receiving member with increased sensitivity compared to the ETAC sensor. The array sensor can measure much smaller area coverages for the same amount of toner in a test pattern than an ETAC sensor. According to various exemplary embodiments, a method of measuring low residual mass of toner is disclosed.

Also, an array sensor can be operated in either specular or in diffuse mode. In specular mode, the array sensor typically gives a high response when it detects a bare photoreceptor and gives a low response when it detects an amount of toner on the photoreceptor.

Figure 16:
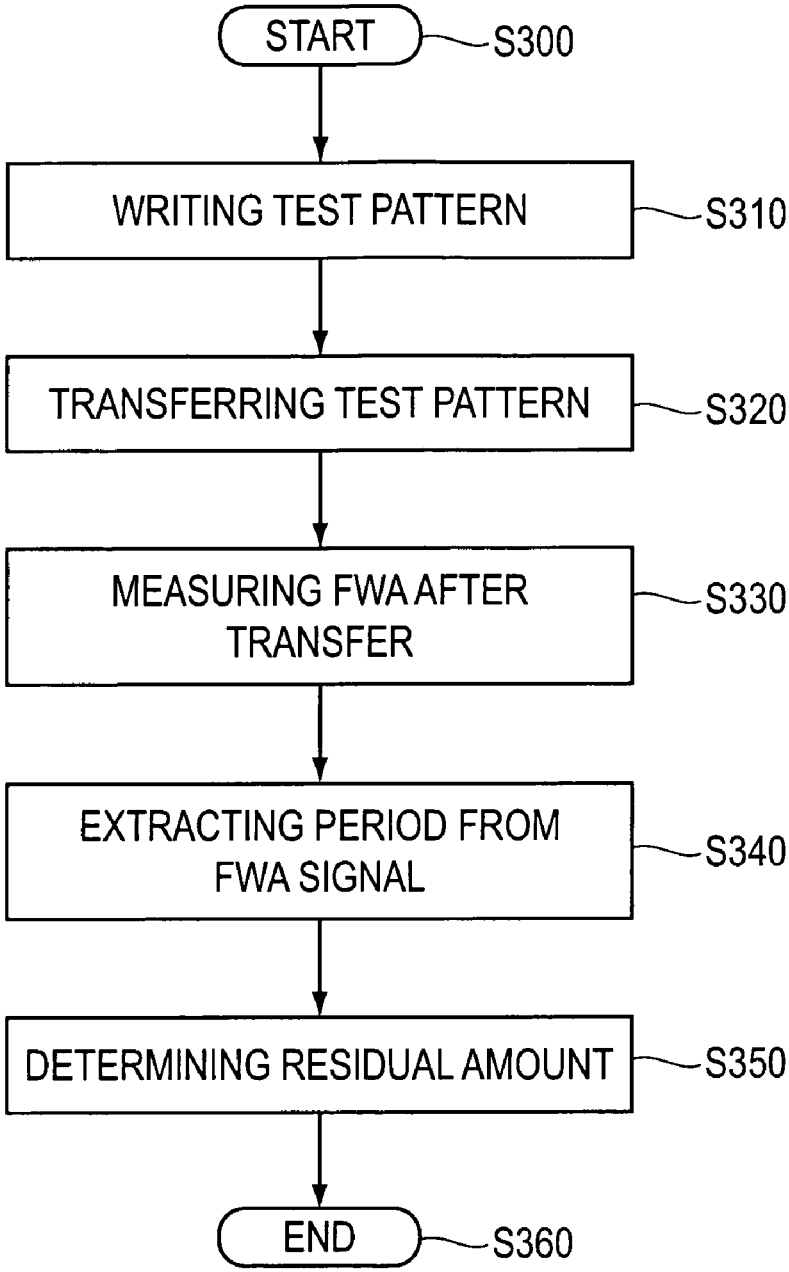
FIG. 16 is a flowchart of an exemplary embodiment of a method of determining residual amounts of toner using array sensors.

FIG. 16 is a flowchart illustrating a method of measuring residual mass of a toner on, for instance, a photoreceptor. The method starts at step S300 and continues to step S310. During step S310, a test pattern is created. In various exemplary embodiments, the test pattern consists of thin diagonal lines oriented slightly off the vertical. The optimal line thickness and angle depends on the imaging conditions and can be chosen to give the highest precision. Next, during step S320, the test pattern is transferred to paper. When transfer is complete during step S320, and some residual toner may still be present on the photoreceptor, an image of the residual test pattern is collected with the array imager at step S330. The array image is dominated by sensor noise when the residual mass is low. However, when a two dimensional Fourier transform of the signal is taken at step S340, there is a peak at the wave vector of the test pattern. The two dimensional Fourier transform typically has higher noise along the x and y axes. Orienting the thin diagonal lines of the test pattern at an angle to the process direction brings the peak in Fourier space off the x axis and increases the sensitivity of the measurement. An alternative to taking the Fourier transform is to perform a convolution with a sine and cosine wave at the known frequency and calculate the sum of the squares. The amplitude determined in this way is proportional to the residual toner. This processing is performed in step S350. In various exemplary embodiments, the determination of the residual mass of toner is performed by comparing the processed image captured with the array image of the residual toner to a calibrated scale. Finally, the method of determining residual mass of toner on a photoreceptor ends in step S360.

Figure 17:
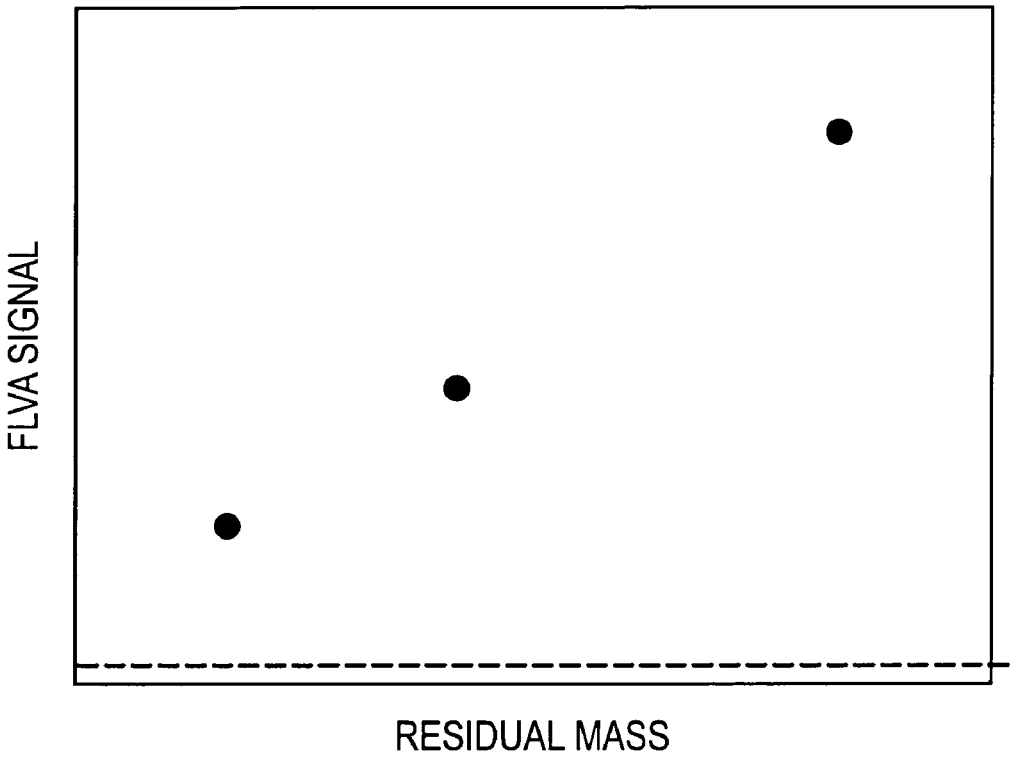
FIG. 17 illustrates an exemplary embodiment of the evolution of the full-width array (FWA) sensor signal with respect to the fractional area coverage of a simulated residual toner mass.

FIG. 17 illustrates an exemplary embodiment of the evolution of the full-width array (FWA) sensor signal with respect to the fractional area coverage of a simulated residual toner mass.

The methods described above, according to various exemplary embodiments of this invention, allow for the precise determination of any amount of toner that is either left after transfer, hence affects the transfer efficiency of the printing apparatus, or allows for the measure of banding and the correction thereof.

According to various exemplary embodiments of this invention, control of the amount of residual toner after transfer is enabled wherein based on the determination of the residual amount of toner, the printing parameters can be adjusted in order to decrease or completely eliminate the amount of post-transfer residual toner.

Accordingly, if a feedback loop is employed, transfer efficiency can be maintained at a very high value in a control scheme by the features described in this invention because the techniques described above allow the detection of very low level of residual mass. Moreover, although Fourier analysis has been exemplified to extract the specific frequencies, more efficient digital signal processing techniques can be used to extract the signal.

Because transfer efficiency affects color drift on color printers, measuring the transfer efficiency with high precision as part of a feedback control loop allows, in various exemplary embodiments of this invention, to control color drift by monitoring residual mass on the photoreceptor.

While this invention has been described in conjunction with the exemplary embodiments outline above, various alternative, modifications, variations, improvements, and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the claims as filed and as they may be amended, are intended to embrace all known or later developed alternatives, modifications, variations, improvements, and/or substantial equivalents.

What is claimed is:

1. A method of determining a residual toner mass on a receiving member, comprising:

providing one or more test patterns to the receiving member;

transferring the one or more test patterns from the receiving member to a transfer medium;

determining a sensor signal obtained after transferring the one or more test patterns, processing the sensor signal obtained after transferring to determine peak-to-peak amplitude of the sensor signal; and transforming the peak-to-peak amplitude to physically meaningful units using a calibrated scale to determine an amount of residual toner mass based on the processed sensor signal.

2. The method of claim 1, wherein the sensor signal is processed using a Fourier transform technique.

3. The method of claim 2, wherein determining an amount of the residual toner mass comprises:

determining peak-to-peak amplitude from the peak frequency in the Fourier transform; and transforming the peak-to-peak amplitude to physically meaningful units using the calibrated scale.

4. The method of claim 2, wherein the sensor signal is processed by using, on an image, a two-dimensional Fourier transform technique.

5. The method of claim 2, wherein the sensor signal is processed by using a Fourier transform technique on a plurality of patches.

6. The method of claim 1, wherein the determined amount of toner is used to calculate toner transfer efficiency.

7. The method of claim 1, wherein the one or more test patterns are made of a plurality of patches that are sequentially sensed by optical sensors coupled to the receiving member.

8. The method of claim 1, wherein the one or more test patterns are made of substantially parallel lines.

9. The method of claim 1, wherein the step of providing comprises at least one of generating one or more test patterns to the receiving member and printing one or more test patterns to the receiving member.

10. The method of claim 1, wherein the sensor signal is processed using at least one of a point sensor and an array-type sensor.

11. The method of claim 10, wherein the at least one of a point sensor includes ETAC sensors.

12. The method of claim 1, wherein the receiving member is at least one of a photoreceptor belt, a photoreceptor drum, an intermediate belt and an intermediate drum.

13. The method of claim 1, further comprising automatically adjusting the amount of post transfer residual toner mass based on the determined amount of residual toner mass.

14. The method of claim 1, wherein the transfer medium comprises paper.

15. A system for determining a residual toner mass on a receiving member, comprising:

optical sensors coupled to a receiving member, and a controller that:

generates one or more test patterns;

transfers the one or more test patterns generated from the receiving member to a transfer medium;

determines a sensor signal obtained after transferring the one or more test patterns by the optical sensors;

processes the determined sensor signal to obtain a peak-to-peak amplitude of the sensor signal; and transforms the peak-to-peak amplitude to physically meaningful units using a calibrated scale to determine an amount of residual toner mass based on the processed sensor signal.

16. The system of claim 15, wherein the sensor signal is processed using a Fourier transform technique.

17. The system of claim 16, wherein determining an amount of the residual toner mass based on the processed sensor signal comprises:

determining peak-to-peak amplitude from the peak frequency in the Fourier transform; and transforming the peak-to-peak amplitude to physically meaningful units using the calibrated scale.

18. The system of claim 17, wherein the determined amount of toner is used to calculate toner transfer efficiency.

19. The system of claim 15, wherein the optical sensors are point sensors.

20. The system of claim 19, wherein the point sensors are ETAC sensors.

21. The system of claim 15, wherein the optical sensors are array-type sensors.

22. The system of claim 15, wherein the receiving member is at least one of a photoreceptor belt, a photoreceptor drum, an intermediate belt and an intermediate drum.

23. The system of claim 15, wherein the transfer medium comprises paper.

24. A xerographic marking device, comprising:

a receiving member;

at least one of an array-type optical sensor and a point optical sensor arranged on the receiving member; and a controller that:

generates one or more test patterns;

transfers the one or more test patterns generated from the receiving member to a transfer medium;

determines a sensor signal obtained after transferring the one or more test patterns by the optical sensors;

processes the determined sensor signal to obtain a peak-to-peak amplitude of the sensor signal; and transforms the peak-topeak amplitude to physically meaningful units using a clibrated scale to determine an amount of residual toner mass based on the processed sensor signal.

25. The xerographic marking device of claim 24, wherein the optical point sensors are ETAC sensors.

26. The xerographic marking device of claim 24, wherein the receiving member is one of a photoreceptor belt or drum an intermediate belt or drum.

27. A machine-readable medium that provides instructions for determining a residual toner mass on a receiving member, the instructions, when executed by a processor, cause the processor to perform operations comprising:

generating one or more patterns;

transferring the generated one or more test patterns from the receiving member to a transfer medium;

determining a signal obtained after transferring the one or more test patterns;

processing the signal to obtain a peak-to-peak amplitude of the sensor signal; and transforming the peak-to-peak amplitude to physically meaningful units using a calibrated scale to determine an amount of the residual toner mass based on the processed signal.

* * * * *